US007586031B1

(12) United States Patent
Baker

(10) Patent No.: US 7,586,031 B1
(45) Date of Patent: Sep. 8, 2009

(54) METHOD FOR GENERATING A RINGTONE

(76) Inventor: Alexander Baker, 15911 Valley Wood Rd., Sherman Oaks, CA (US) 91403

( * ) Notice: Subject to any disclaimer, the term of this patent is extended or adjusted under 35 U.S.C. 154(b) by 0 days.

(21) Appl. No.: 12/025,812

(22) Filed: Feb. 5, 2008

(51) Int. Cl.
*G10H 1/00* (2006.01)

(52) U.S. Cl. ..... 84/609; 84/649

(58) Field of Classification Search ..... 84/600–602, 84/609, 649
See application file for complete search history.

(56) References Cited

U.S. PATENT DOCUMENTS

| | | | | |
|---|---|---|---|---|
| 5,452,354 | A * | 9/1995 | Kyronlahti et al. | 379/373.02 |
| 6,094,587 | A * | 7/2000 | Armanto et al. | 455/567 |
| 6,501,967 | B1 * | 12/2002 | Makela et al. | 455/567 |
| 6,810,272 | B2 * | 10/2004 | Kraft et al. | 455/566 |
| 6,907,113 | B1 * | 6/2005 | Holm et al. | 379/88.23 |
| 6,911,592 | B1 * | 6/2005 | Futamase et al. | 84/622 |
| 6,967,276 | B2 * | 11/2005 | Futamase et al. | 84/622 |
| 7,012,185 | B2 * | 3/2006 | Holm et al. | 84/645 |
| 7,050,573 | B2 * | 5/2006 | Okazaki et al. | 379/373.02 |
| 7,058,428 | B2 * | 6/2006 | Yamaki et al. | 455/567 |
| 7,161,081 | B2 * | 1/2007 | Futamase et al. | 84/622 |
| 7,164,906 | B2 * | 1/2007 | Herberger et al. | 455/414.1 |
| 7,196,260 | B2 * | 3/2007 | Schultz | 84/613 |
| 7,232,949 | B2 * | 6/2007 | Hruska et al. | 84/610 |
| 7,241,946 | B2 * | 7/2007 | Huang et al. | 84/602 |
| 7,259,311 | B2 * | 8/2007 | Ashida | 84/454 |
| 7,302,253 | B2 * | 11/2007 | Moody et al. | 455/412.2 |
| 7,394,012 | B2 * | 7/2008 | Schultz | 84/615 |
| 7,418,258 | B2 * | 8/2008 | Moody et al. | |
| 7,442,868 | B2 * | 10/2008 | Park et al. | 84/603 |
| 7,498,504 | B2 * | 3/2009 | Bourgeois | 84/609 |
| 2001/0024490 | A1 * | 9/2001 | Oda | 379/88.01 |
| 2002/0018556 | A1 * | 2/2002 | Okazaki et al. | 379/373.02 |
| 2002/0170415 | A1 * | 11/2002 | Hruska et al. | 84/609 |
| 2003/0079598 | A1 * | 5/2003 | Nakayama | 84/609 |
| 2004/0139842 | A1 * | 7/2004 | Brenner et al. | 84/477 R |
| 2004/0154461 | A1 * | 8/2004 | Havukainen et al. | 84/645 |
| 2004/0159219 | A1 * | 8/2004 | Holm et al. | 84/645 |
| 2004/0173082 | A1 * | 9/2004 | Bancroft et al. | 84/612 |
| 2005/0036603 | A1 * | 2/2005 | Hughes | 379/372 |
| 2005/0150359 | A1 * | 7/2005 | Huang et al. | 84/602 |
| 2005/0211065 | A1 * | 9/2005 | Ashida | 84/454 |
| 2006/0011044 | A1 * | 1/2006 | Chew | 84/609 |
| 2006/0027080 | A1 * | 2/2006 | Schultz | 84/613 |
| 2006/0130636 | A1 * | 6/2006 | Toledano et al. | 84/600 |
| 2006/0137513 | A1 * | 6/2006 | Billon et al. | 84/600 |
| 2006/0293089 | A1 * | 12/2006 | Herberger et al. | 455/567 |
| 2007/0072648 | A1 * | 3/2007 | Stoops | 455/566 |
| 2007/0124452 | A1 * | 5/2007 | Mohammed | 709/223 |
| 2007/0193435 | A1 * | 8/2007 | Hardesty et al. | 84/609 |
| 2007/0199432 | A1 * | 8/2007 | Abe et al. | 84/645 |

(Continued)

FOREIGN PATENT DOCUMENTS

EP 1736961 A1 * 12/2006

*Primary Examiner*—David S. Warren

(57) ABSTRACT

A method for generating a ringtone for efficiently generating an individualized melodic ringtone specific to each unique phone number. The method for generating a ringtone generally includes providing a phone number including a plurality of digits, establishing a tonal center, determining a plurality of pitches for the plurality of digits with respect to the tonal center, assigning the plurality of digits to the plurality of pitches, determining a melody with respect to the plurality of pitches of said plurality of digits and playing the melody.

20 Claims, 3 Drawing Sheets

| MOOD (mode) Phone Digit | HAPPY (major) | SAD (natural minor) | FOREIGN (harmonic minor based on key 4th above tone center) | BLUE (blues scale) | HEROIC (mix-olydian) | MAGICAL (lydian) | PRIMITIVE (pentatonic) |
|---|---|---|---|---|---|---|---|
| 0 | Major 7th below | Minor 7th below | Minor 7th below | Minor 7th below | Minor 7th below | Major 7th below | Minor 7th below |
| 1 | root | root | root | root | root | Root | Root |
| 2 | Major 2nd | Major 2nd | Minor 2nd | Minor 3rd | Major 2nd | Major 2nd | Trill Major 2nd/minor 3rd |
| 3 | Major 3rd | Minor 3rd | Major 3rd | Minor 3rd bent up half step | Major 3rd | Major 3rd | Minor 3rd |
| 4 | Perfect 4th | Perfect 4th | Perfect 4th | Perfect 4th | Perfect 4th | Augmented 4th | Perfect 4th |
| 5 | Perfect 5th | Perfect 5th | Perfect 5th | Diminished 5th | Perfect 5th | Perfect 5th | Perfect 5th |
| 6 | Major 6th | Minor 6th | Minor 6th | Perfect 5th | Major 6th | Major 6th | Trill 5th/ minor 7th |
| 7 | Major 7th | Minor 7th | Minor 7th | Minor 7th bent up whole step | Minor 7th | Major 7th | Minor 7th |
| 8 | Octave | Octave | Octave | Octave | Octave | Octave | Octave |
| 9 | Major 9th | Major 9th | Minor 9th | Minor 10th | Major 9th | Major 9th | Trill Octave/ minor 10th |
| 0 | Major 10th | Minor 10th | Major 10th | Minor 10th bent up half step | Major 10th | Major 10th | Minor 10th |

U.S. PATENT DOCUMENTS

2007/0245882 A1* 10/2007 Odenwald ..... 84/609
2007/0270167 A1* 11/2007 Mardiks et al. ..... 455/456.4
2008/0026732 A1* 1/2008 Goldfarb ..... 455/414.1
2008/0045186 A1* 2/2008 Black et al. ..... 455/413
2008/0047415 A1* 2/2008 Schultz ..... 84/723
2008/0066609 A1* 3/2008 Bourgeois ..... 84/609
2008/0156178 A1* 7/2008 Georges et al. ..... 84/645
2008/0223200 A1* 9/2008 Kwak ..... 84/610
2008/0254824 A1* 10/2008 Moraes ..... 455/556.1
2008/0280596 A1* 11/2008 Moody et al. ..... 455/412.2
2009/0029683 A1* 1/2009 Moody et al. ..... 455/412.2
2009/0029685 A1* 1/2009 Willis ..... 455/414.1

* cited by examiner

| MOOD (mode) Phone Digit | HAPPY (major) | SAD (natural minor) | FOREIGN (harmonic minor based on key 4th above tone center) | BLUE (blues scale) | HEROIC (mix-olydian) | MAGICAL (lydian) | PRIMITIVE (pentatonic) |
|---|---|---|---|---|---|---|---|
| 0 | Major 7th below | Minor 7th below | Minor 7th below | Minor 7th below | Minor 7th below | Major 7th below | Minor 7th below |
| 1 | root | root | root | root | root | Root | Root |
| 2 | Major 2nd | Major 2nd | Minor 2nd | Minor 3rd | Major 2nd | Major 2nd | Trill Major 2nd/minor 3rd |
| 3 | Major 3rd | Minor 3rd | Major 3rd | Minor 3rd bent up half step | Major 3rd | Major 3rd | Minor 3rd |
| 4 | Perfect 4th | Perfect 4th | Perfect 4th | Perfect 4th | Perfect 4th | Augmented 4th | Perfect 4th |
| 5 | Perfect 5th | Perfect 5th | Perfect 5th | Diminished 5th | Perfect 5th | Perfect 5th | Perfect 5th |
| 6 | Major 6th | Minor 6th | Minor 6th | Perfect 5th | Major 6th | Major 6th | Trill 5th/ minor 7th |
| 7 | Major 7th | Minor 7th | Minor 7th | Minor 7th bent up whole step | Minor 7th | Major 7th | Minor 7th |
| 8 | Octave | Octave | Octave | Octave | Octave | Octave | Octave |
| 9 | Major 9th | Major 9th | Minor 9th | Minor 10th | Major 9th | Major 9th | Trill Octave/ minor 10th |
| 0 | Major 10th | Minor 10th | Major 10th | Minor 10th bent up half step | Major 10th | Major 10th | Minor 10th |

FIG. 2

METHOD FOR GENERATING A RINGTONE

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to ringtones and more specifically it relates to a method for generating a ringtone for efficiently generating an individualized melodic ringtone specific to each unique phone number.

2. Description of the Related Art

Any discussion of the related art throughout the specification should in no way be considered as an admission that such related art is widely known or forms part of common general knowledge in the field.

Ringtones have been in use for years with phones and are generally the primary way in which an individual make take notice of an incoming call. Ringtones are often comprised of one or more generic tones, which may or may not be of different octaves, played when a phone is receiving an incoming call. Many past ringtones are comprised of a generic sound which may be annoying to some phone users and which also may make it difficult to distinguish which phone is ringing when there is a plurality of nearby phones.

There have been advances in the ringtone industry to try and overcome the generic way in which phones ring. Some of these advances include monophonic ringtones, polyphonic ringtones and truetone ringtones. Monophonic ringtones are ringtones that can play only one type of musical tone at a time. Polyphonic ringtones can generally play several types of tones at a time and truetones are ringtones encoded with a high fidelity format such as MP3 or WMA format.

These ringtones (i.e. monophonic, polyphonic, truetone) are generally able to play renditions of popular artist recorded songs and are formatted for such. Playing artist recorded songs may still be generic to some people in that many people may have the same ringtone which would make the particular ringtone not unique. Because of the inherent problems with the related art, there is a need for a new and improved method for generating a ringtone for efficiently generating an individualized melodic ringtone specific to each unique phone number.

BRIEF SUMMARY OF THE INVENTION

The general purpose of the present invention is to provide a method for generating a ringtone that has many of the advantages of the ringtones mentioned heretofore. The invention generally relates to a ringtone which includes a phone number, establishing a tonal center, establishing a musical mode and style as chosen by the user, playing a musical rhythm track based upon the tonal center, style and the mode, determining a set musical pitches based upon the mode and tone center (i.e. a musical scale), assigning each phone number digit to the corresponding pitch from within the set (i.e. the corresponding scale degree), thus determining a unique sequence of musical pitches (i.e. a unique melody), and playing the unique melody concurrently with the rhythm track.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a method for generating a ringtone for efficiently generating an individualized melodic ringtone specific to each unique phone number.

Another object is to provide a method for generating a ringtone that correlates a particular phone number and the musical theme implied by the phone number.

An additional object is to provide a method for generating a ringtone that utilizes a format where each digit in a phone number will correspond to a certain musical scale degree.

Another object is to allow users to spontaneously perform enjoyable music in various styles by opening their phones (which automatically starts a rhythm track), and touching digits.

Another object is to facilitate the learning of music theory, as associating digits with musical scale degrees is the foundation of music theory.

A further object is to provide a method for generating a ringtone that allows users to listen to a unique melodic shape, audition various numbers and the various styles and modes available within each number prior to choosing a phone number.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein:

FIG. 2 is a diagram illustrating an embodiment of a preferred algorithm including the correlation between the style options, mode, scale degree and phone number digits.

DETAILED DESCRIPTION OF THE INVENTION

A. Overview

Figure 1:
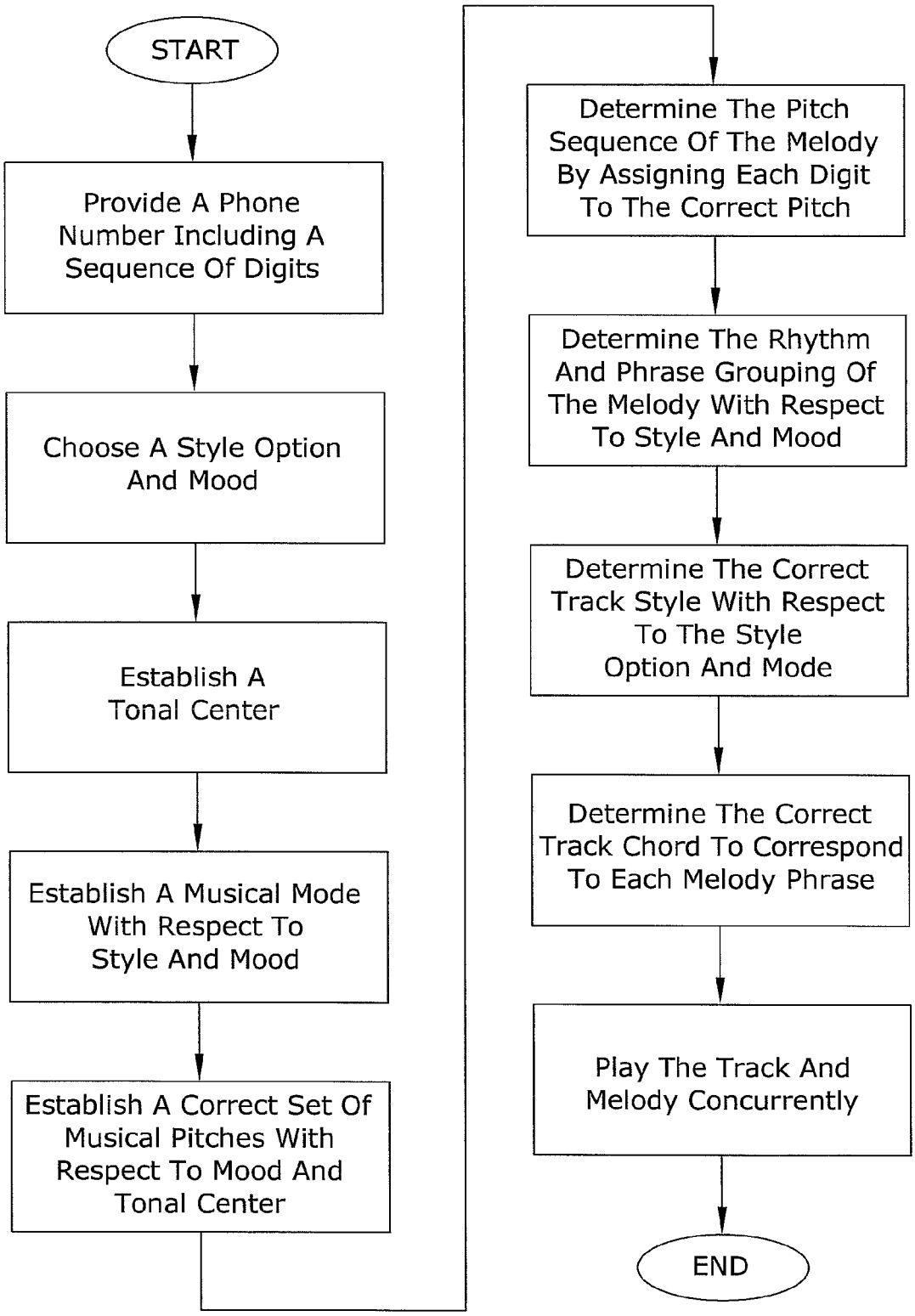
FIG. 1 is a flowchart illustrating a process of the present invention.
Figure 3A:
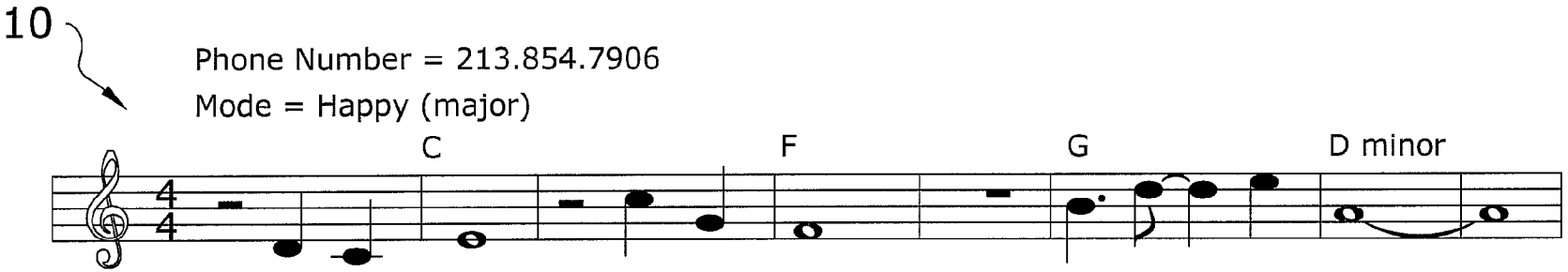
FIGS. 3*a* through 3*c* are musical diagrams illustrating the present invention being played in various modes and with a random phone number, wherein the musical notes are derived from the algorithm.
Figure 3B:
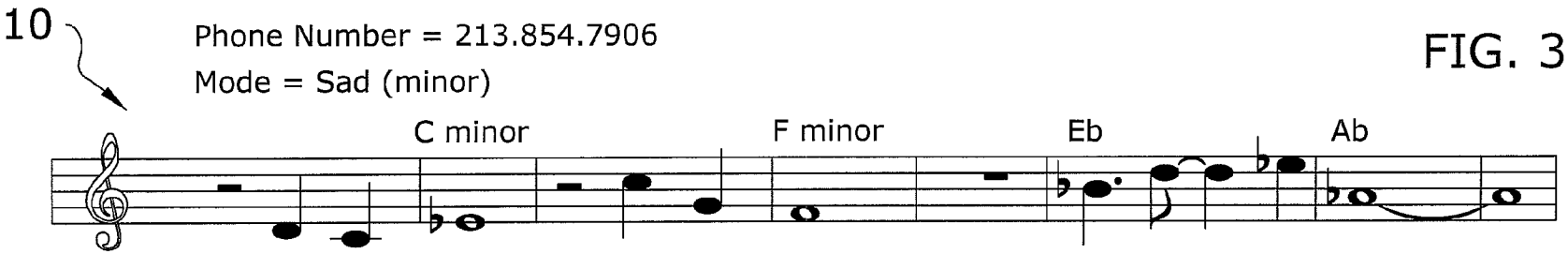
Figure 3C:
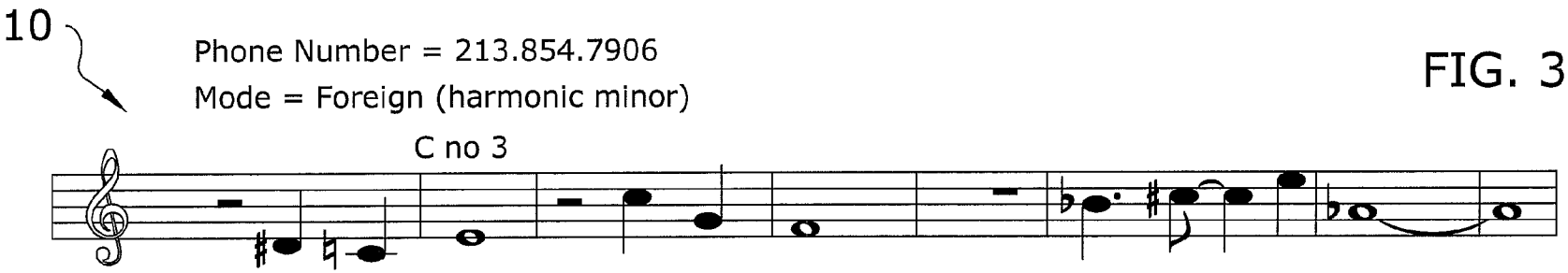

Turning now descriptively to the drawings, in which similar reference characters denote similar elements throughout the several views, FIGS. 1 through 3*c* illustrate a method for generating a ringtone system 10, which comprises providing a phone number including a plurality of digits, providing a plurality of style options each including at least one defined mode, establishing a tonal center, providing a predetermined musical scale with respect to the tonal center and the style option, correlating each pitch of the predetermined scale to the corresponding digit within the plurality of digits, determining a plurality of pitches for the plurality of digits, the predetermined musical scale and the style option, assigning the plurality of digits to the plurality of pitches, determining the melody of the plurality of digits and playing the melody.

The actual melody pitch choices in any particular ringtone performance will be determined solely by the digits of the incoming or outgoing phone call. Each digit in the incoming number translates to a scale degree of the tonal center established by the track, adjusted to user-chosen style and mode.

B. Ringtones

Ringtones utilized with the present invention can be either incoming or outgoing. Incoming ringtones are activated by an incoming phone call. Outgoing ringtones are initiated upon opening or activating the phone. Outgoing ringtones are also melodically user-interactive. Each ringtone consists of two components: a track and a melody. The track and the melody interact in ways spelled out in a "recipe". The recipe is a small data set associated with a, particular style, which determines the rhythm of the melody (if incoming), and the chord changes of the track (both incoming and outgoing).

i. Track

The track is generally comprised of background music. The track is preferably without defined melody and preferably serves three purposes which are the following: to announce the beginning of the ringtone, to establish a musical style and mood (i.e. there are to be a multitude of track choices in every musical style with each musical style available in the plurality of modes provided), and to establish a musical modal "tonal center" (e.g. the key of "C", etc.).

The track is performed by triggering individual loopable samples from a set of pre-recorded looping samples. The looping samples are comprised of a digitally recorded musical instrument or combination of instruments. Each sample in the set preferably has identical instrumentation and identical tempo; however each sample in the set is based on one of the plurality of chord root choices available (i.e. the "1 chord", the "2 chord", the "3 chord", etc.). It is appreciated that the mode dictates the spelling of all of the chords.

The track begins playing, beginning with the chord specified in its recipe, and loops until the melody is detected. A particular recipe may specify chord changing on the last note of each melodic phrase, with the last note of each melodic phrase also determining the chord change for the next bar. In this way, the track is able to make intelligent chord change choices based on melodic input. The tracks will intelligently change chords, based on melody input. It is appreciated that any number of chord change recipes can be constructed.

ii. Melody

The melody is a series of musical pitches, grouped in phrases, and defined by the scale degrees implied by each digit in the incoming phone number or outgoing phone number. The melody is performed on a "melody instrument" appropriate to the style, and/or chosen by the user. A plurality of individual melody-note samples will comprise each melody instrument. It is appreciated that the melody is preferably modal, and preferably matches the tonal center. The rhythm of an incoming melody is given in the "recipe" (i.e. by an algorithm shown in FIG. 2) which considers style and other factors.

During outgoing calls, an opening flip of the phone (or during a dialing session) causes the phone to trigger an outgoing track, thus establishing mood and tonal center of the outgoing call. On outgoing calls initiated by any automatic dialing feature, outgoing melody is rendered automatically using the same rules as incoming calls. On outgoing calls dialed by hand, melody is played live by the user, thus making the cell phone a proper musical instrument.

The recipe makes intelligent choices about the track's chord changes based on melody input, while the track always stays in perfect rhythm. Outgoing call tones fade out whenever the call is answered. The receiver (or person receiving the phone call) preferably hears just a little bit of the fading theme, along with the caller's voice.

It is appreciated that human vocals are among choices of melody instruments. Each vocal-based melody instrument will be comprised of a collection of vocal samples. Each vocal sample says the name of the digit, and otherwise conforms to the same rules as any other melody instrument, "one" is the root of the scale, "two" is the second degree of the scale, and so on.

Each melody instrument sample ends with an "ornament". The ornament is an alteration or beautification of the original pitch by transitioning smoothly to other nearby pitches available within the current mode. Each sample may be heard in its entirety or as a shortened (truncated) version, wherein a typical pattern is to use a shortened version of the sample for all notes in the melody, except those notes coming at the end of phrases.

The scale degree is part of a predetermined table to label each digit of the phone number a particular pitch (e.g. minor 7 below, major 7 below, root, perfect $5^{th}$, major $3^{rd}$, octave, etc.) with respect to the tonal center. The scale degree may also change for each corresponding style option and mode chosen, thus producing a different series of pitches for each style option and mode even with the same phone number.

C. Web Based User Interface

The present invention may include a web based user interface to aid in the selection of tracks and melodies and also assist the user in providing a control means for the present invention. In one embodiment of the present invention, the user picks a track style by encountering a visual "landscape" inside a crystal ball of musical territory, wherein arrow buttons control rotation of the ball thus zooming in and out. It is appreciated that the interface may or may not be web based and may be operated via various devices (e.g. handheld phone, personal computer, etc.).

The user may zoom or direct themselves to various broad categories of music (e.g. classical, jazz, blues, rock, country, Latin, etc.), more specific categories of music (e.g. primitive, baroque, classical, romantic, impressionistic, 20th century, modern film score, early jazz, New Orleans jazz, bebop jazz, smooth jazz, Latin jazz, jazz-rock fusion, classic rock, punk rock, 80s rock, alternative rock, heavy metal, blues rock, Latin jazz, flamenco, old school country, modern country, bluegrass, folk, old school r&b, modern r&b, gangsta hip hop, pop hip hop, traditional jazz, jazz fusion, smooth jazz, world music, ambient, new age, electronica, top 40, dance 1, dance 2, dance 3, modern film score 1, modern film score 2, etc.) or various assortments of instruments.

D. Ring Style

The present invention may include a style option, wherein the user assigns a particular style (e.g. happy, primitive, magical, blue, foreign, heroic, sad, ambiguous, etc.) to a particular phone number. It is appreciated that the styles may represent various different properties, such as but not limited to moods. The user may also assign varying style options depending on if the particular phone number is incoming or outgoing. The style options are also preferably accompanied by a particular mode (e.g. happy—major, primitive—pentatonic, magical—Lydian, blue—blues scale, foreign—harmonic minor, heroic—mixolydian, sad—minor, ambiguous "?", etc.). Users can choose a musical mode or have one defaulted to them according to the style option already chosen.

In the preferred embodiment, the style options are displayed upon a wheel configuration and identified by a circular array of iconic buttons in the web based user interface; however it is appreciated that the style options may be available to the user in a variety of manners or the user may automatically be assigned a particular style option. The user may assign different style options to different callers in their phone book. Phone number melodies may be auditioned by typing the number in input field, or generated randomly by various programs, such as JAVASCRIPT™ registered by Sun Microsystems, Inc.

E. Sound Engine Architecture

Onboard the phone (e.g. wireless, etc.) is a hardware and software "sound engine". The sound engine includes a plurality of sound samples to comprise the raw material for each ringtone, a plurality of samples for the track, and a plurality of samples to comprise the available melody pitches. The sound engine is a sample player with a 3 voice polyphony. One voice is preferably dedicated to playing the track and the other two voices are dedicated to playing melody samples.

Essentially melody samples play monophonically, but may overlap and cross-fade from one sample to the next. Additionally the sound engine contains an "effects generator" algorithm capable of generating standard music processing effects such as "reverb" and "delay". This effects generator stage is the last stage before the output. It is appreciated that variations of the algorithm may exist to account for different pitches or tones desired by the user.

Each melody output is split into two signals. One signal from each melody output is routed to the input of the effects generator. Each of the 3 sample outputs are routed into one input of a 4 input mixer. The output of the effects generator is routed into the 4th mixer input. The output of the mixer thus combines the sound of the track, the melody samples, and the effects. This output is routed to the amplifier, which goes on to the speaker.

F. Operation of Preferred Embodiment

In use, because each telephone number is unique, each generated melodic shape is unique. Each of these unique melodic shapes can exist as any of a plurality of variations corresponding to the respective style options available in the algorithm. In addition to all of the individual compositions described above, the present invention may be utilized in an application similar to a symphonic meta-composition, which is a complete rendition of every melodic shape, rendered in every available style, one after the other, in numeric order from phone number 000-000-0000 to phone number 999-999-9999 (i.e. there may be more or less phone numbers depending on the countries included). It is appreciated that each recipe may also include a song title, wherein the song title may be arranged as a "Name" plus the phone number being utilized plus the mode being utilized.

An example phone number ABC-DEF-GHIJ, chosen with a tonal center, a first style option chosen with a first mode thus producing a first configuration of the scale degree to determine the plurality of pitches for each of the digits (i.e. represented by letters in this case) of the phone number. Thus, for the example recipe with the example phone number, the track may begin on the 1 chord, and the melody would play A and B in bar 1, wherein the track stays on the 1 chord for bar 2. The melody plays C on beat 1 of bar 2, followed by melody notes D and E. The track changes to the 5 chord for bar 3. Melody plays F on beat 1 of bar 3, followed by G-H-I-J.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A method of automatically generating a ringtone for an incoming or outgoing call, comprising:

providing a phone number including a sequence of digits;

choosing a style option and a mode option;

establishing a tonal center determinant on said style option and said mode option;

automatically determining a sequence of pitches for said sequence of digits with respect to said tonal center, said style option, and said mode;

automatically assigning said sequence of digits to said sequence of pitches;

automatically determining a melody with respect to said sequence of pitches of said sequence of digits; and playing said melody.

2. The method of generating a ringtone of claim 1, including a sequence of predetermined scale degrees, wherein each one of said predetermined scale degrees corresponds to each of said sequence of digits.

3. The method of generating a ringtone of claim 2, wherein said sequence of pitches are determined from said sequence of digits and said tonal center.

4. The method of generating a ringtone of claim 1, wherein said style option and said mode option are chosen by a user.

5. The method of generating a ringtone of claim 1, wherein said melody is grouped into rhythmic phrases according to an algorithmic recipe.

6. The method of generating a ringtone of claim 1, providing a step of dialing said sequence of digits of said phone number on a phone, wherein said melody is concurrently played in real-time with a background track as said sequence of digits are dialed.

7. The method of generating a ringtone of claim 1, providing a step of activating a dialing session upon a phone, wherein said melody is played in real-time.

8. The method of generating a ringtone of claim 1, wherein said melody is played on a phone.

9. The method of generating a ringtone of claim 1, wherein said melody is played upon an incoming call or an outgoing call.

10. A method of automatically generating a ringtone unique to each phone number for an incoming or outgoing call, comprising:

providing a phone number including a sequence of digits;

choosing a style option and a mode option;

automatically establishing a tonal center determinant on said style option and said mode option;

automatically providing a predetermined musical scale with respect to said tonal center;

automatically correlating each degree of said predetermined musical scale to each one of said sequence of digits;

automatically determining a sequence of pitches for said sequence of digits with respect to said tonal center, said predetermined scale degree, said style option, and said mode;

automatically assigning said sequence of digits to said sequence of pitches;

automatically determining a melody of said sequence of digits; and playing said melody.

11. The method of generating a ringtone of claim 10, wherein said style option and said mode option are chosen by a user.

12. The method of generating a ringtone of claim 10, wherein said melody is grouped into rhythmic phrases according to an algorithmic recipe.

13. The method of generating a ringtone of claim 12, wherein said melody is grouped into rhythmic phrases during incoming calls.

14. The method of generating a ringtone of claim 10, providing a step of dialing said sequence of digits of said phone number on a phone, wherein said melody is concurrently played in real-time with a background track as said sequence of digits are dialed.

15. The method of generating a ringtone of claim 10, providing a step of activating a dialing session upon a phone, wherein said melody is played in real-time.

16. The method of generating a ringtone of claim 10, wherein said melody is played upon an incoming call or an outgoing call.

17. The method of generating a ringtone of claim 10, including providing a web based user interface to aid in a selection of said style option, said mode, and to download audio samples.

18. A method of generating a phone number specific ringtone while placing an outgoing call, comprising:

providing a phone;

activating said phone;

playing a track to introduce a phone number specific ringtone;

establishing a style option and mode option with said track;

establishing a tonal center with said track;

providing an outgoing phone number including a sequence of digits;

dialing said sequence of digits of said outgoing phone number into said phone;

automatically correlating sequence of digits with said tonal center of said style option and said mode option;

creating a melody via said dialing of said sequence of digits; and playing said melody with said track to complete said phone number specific ringtone.

19. The method of claim 18, including a web interface, wherein said phone connects to said web interface to aid in a selection of said track.

20. The method of claim 18, including a step of briefly continuing to play said phone number specific ringtone after a receiver answers said outgoing call.

* * * * *